US008344977B2

(12) United States Patent
Park et al.

(10) Patent No.: US 8,344,977 B2
(45) Date of Patent: Jan. 1, 2013

(54) LIQUID CRYSTAL DISPLAY AND DRIVING METHOD THEREOF

(75) Inventors: Ju-Young Park, Seoul (KR); Kyung-Hun Lee, Masan-si (KR)

(73) Assignee: Samsung Display Co., Ltd. (KR)

( * ) Notice: Subject to any disclaimer, the term of this patent is extended or adjusted under 35 U.S.C. 154(b) by 1259 days.

(21) Appl. No.: 12/125,651

(22) Filed: May 22, 2008

(65) Prior Publication Data

US 2008/0316157 A1 Dec. 25, 2008

(30) Foreign Application Priority Data

May 22, 2007 (KR) ..... 10-2007-0049638

(51) Int. Cl.
*G09G 3/36* (2006.01)

(52) U.S. Cl. ..... 345/89; 345/102; 345/87; 345/88; 345/90; 345/91; 345/92; 345/93; 345/94; 345/95; 345/96; 345/97; 345/98; 345/99; 345/100; 345/103; 345/104; 345/204; 345/207; 345/211; 345/212; 345/213

(58) Field of Classification Search ..... 345/87–104, 345/204, 207, 211–213, 690
See application file for complete search history.

(56) References Cited

U.S. PATENT DOCUMENTS

| | | | | |
|---|---|---|---|---|
| 5,933,089 | A * | 8/1999 | Katada | 340/7.55 |
| 6,157,849 | A * | 12/2000 | Cho | 455/566 |
| 6,219,019 | B1 * | 4/2001 | Hasegawa et al. | 345/96 |
| 7,209,134 | B2 * | 4/2007 | Chun et al. | 345/213 |
| 2001/0009411 | A1 * | 7/2001 | Kusanagi | 345/93 |
| 2002/0093476 | A1 * | 7/2002 | Hill et al. | 345/89 |
| 2006/0132408 | A1 * | 6/2006 | Shin et al. | 345/89 |
| 2007/0043523 | A1 * | 2/2007 | Lai et al. | 702/67 |

* cited by examiner

*Primary Examiner* — Alexander S Beck
*Assistant Examiner* — Jeffrey Steinberg
(74) *Attorney, Agent, or Firm* — Innovation Counsel LLP

(57) ABSTRACT

A liquid crystal display comprising: a receiver for receiving power and differential signal; a backlight power supply which supplies the power to a backlight unit; a power-off sensor which senses power-off of the backlight power supply and distorts one of the differential signals; and a controller which senses the distortion of the differential signal and generates an after-image removing gray-scale signal.

14 Claims, 4 Drawing Sheets

LIQUID CRYSTAL DISPLAY AND DRIVING METHOD THEREOF

CROSS-REFERENCE TO RELATED APPLICATIONS

This application claims priority from Korean Patent Application No. 2007-0049638, filed on May 22, 2007 in the Korean Intellectual Property Office, the disclosure of which is incorporated herein by reference.

BACKGROUND OF INVENTION

1. Field of Invention

The present invention relates to a liquid crystal display that is capable of removing an after-image during a power-off operation, and a driving method therefor.

2. Description of Related Art

In general, a liquid crystal display includes a thin film transistor (TFT) substrate and a color filter substrate on which an electric field generating electrode is respectively formed and which face each other, and a liquid crystal layer interposed between the two substrates. The liquid crystal is moved by an electric field generated by applying voltage to the electrodes, thereby varying light transmittance to form an image.

The liquid crystal display includes a liquid crystal panel including a plurality of liquid crystal cells which are connected to gate lines and data lines, a data driver which applies a gray-scale display voltage to the data lines, a gate driver which applies a gate driving signal to the gate lines, a controller which controls the data driver and the gate driver, and a power supply which supplies a driving voltage.

The liquid crystal cell includes a liquid crystal capacitor for charging a gray-scale display voltage, and a TFT for applying the gray-scale display voltage to the liquid crystal capacitor in response to a gate-on voltage. The driving voltage which is supplied by the power supply includes a power voltage, a ground voltage, a gate-on voltage, a gate-off voltage, a common voltage and an analog power voltage.

When power supplied to the power supply is cut off, the power supply outputs an overall output voltage including the power voltage, the gate-on voltage, the gate-off voltage, the common voltage and the analog power voltage into 0V of a ground voltage level. When the gate-on voltage of the ground voltage level is applied to a gate of the TFT, the gray-scale display voltage applied to the liquid crystal capacitor is discharged as a leakage current through a channel of the TFT.

In the conventional liquid crystal display, when the power supply is cut off and the backlight unit is powered off, a pattern which is displayed on the liquid crystal panel does not disappear with the cut off of power but remains for a certain time as an after-image.

SUMMARY OF INVENTION

Accordingly, it is an aspect of the present invention to provide a liquid crystal display which is capable of removing an after-image, The foregoing aspect of the present invention can be achieved by providing a liquid crystal display comprising: a receiver for receiving power and differential signals from outside; a backlight power supply which supplies the power to a backlight unit; a power-off sensor which senses power-off of the backlight power supply and distorts one of the differential signals; and a controller which senses the distortion of a differential signal and generates an after-image removing gray-scale signal.

The controller may include a gray-scale signal generator which generates the after-image removing gray-scale signal.

The gray-scale signal generator may include a differential signal receiver, and a signal comparator which compares the differential signals.

The gray-scale signal generator may include a memory and outputs the after-image removing gray-scale signal which is previously stored therein when the power-off of the backlight unit is sensed.

The gray-scale signal generator outputs a white gray-scale signal when a liquid crystal mode is a normally white mode, and outputs a black gray-scale signal when the liquid crystal mode is a normally black mode.

The power-off sensor may include a transistor which functions as a switch and at least one resistor.

The power-off sensor grounds the differential signal.

The power-off sensor may include a bipolar transistor or a metal oxide silicon (MOS) transistor.

The transistor may include a first terminal connected to a differential signal line which connects the receiver and the controller; a second terminal connected to the resistor which is connected to the backlight power supply; and a third terminal connected to a ground terminal.

The differential signals may include a first clock signal and a clock second signal which has an inverse phase to the first signal.

The foregoing aspect of the present invention can also achieved by providing a method of driving a liquid crystal display, comprising: detecting power-off of a backlight unit by using backlight power and differential signals; generating an after-image removing gray-scale signal when the power-off of the backlight unit is detected; and applying the after-image removing gray-scale signal to a data driver.

One of the differential signals is grounded by using a transistor which functions as a switch and detects the power-off of the backlight unit.

A white or a black gray-scale signal is generated according to a liquid crystal mode, in the generating the after-image removing gray-scale signal.

The white gray-scale signal is generated when the liquid crystal mode is a normally white mode, and the black gray-scale signal is generated when the liquid crystal mode is a normally black mode, in the generating the after-image removing gray-scale signal.

BRIEF DESCRIPTION OF DRAWINGS

The above and/or other aspects of the present invention will become apparent and more readily appreciated from the following description of the exemplary embodiments, taken in conjunction with the accompanying drawings, in which.

DETAILED DESCRIPTION OF EXEMPLARY EMBODIMENTS

Figure 1:
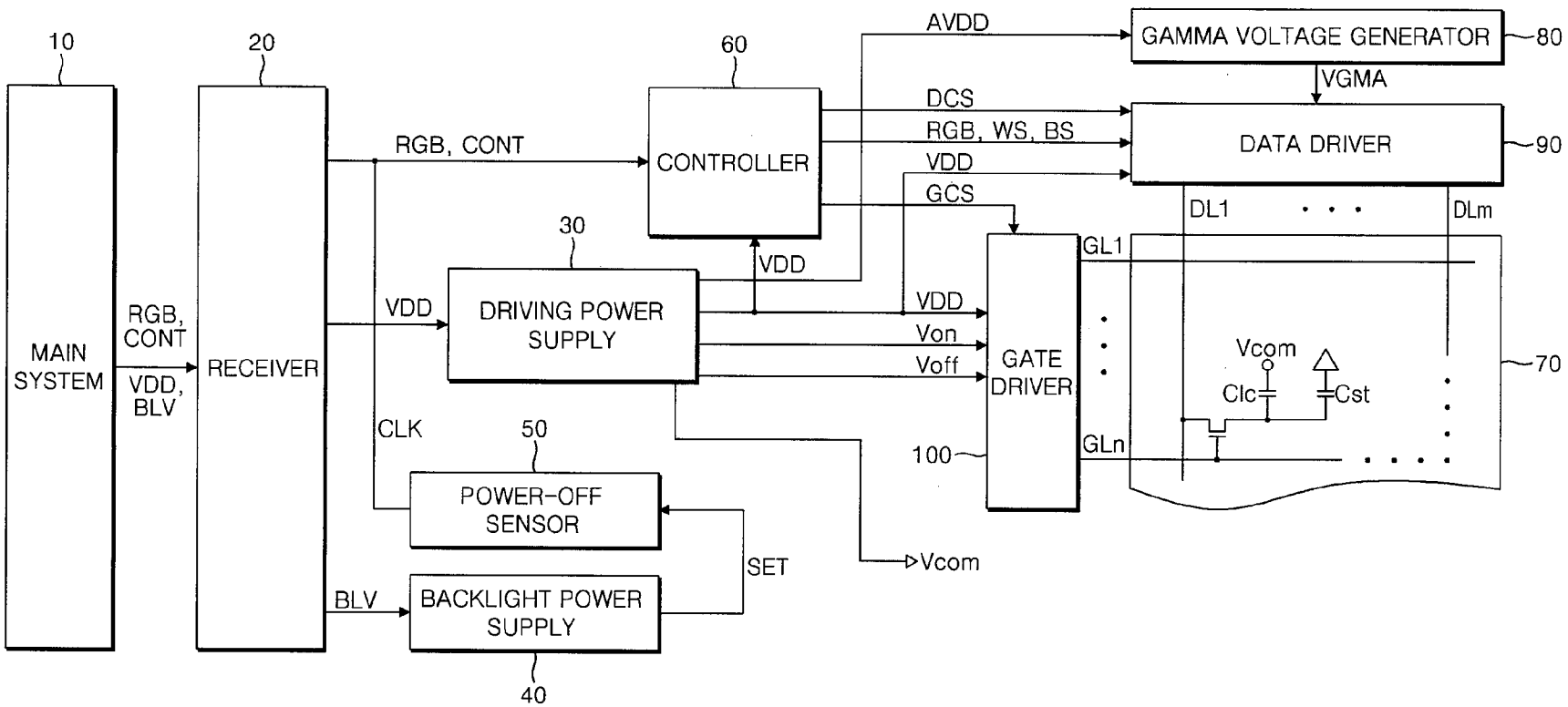
FIG. 1 is a block diagram illustrating a liquid crystal display according to an exemplary embodiment of the present invention.

FIG. 1 is a block diagram illustrating a liquid crystal display according to an exemplary embodiment of the present invention.

As shown in FIG. 1, the liquid crystal display includes a main system 10, a receiver 20, a backlight power supply 40, a controller 60, a driving power supply 30, a power-off sensor 50, a liquid crystal panel 70, a data driver 90, a gate driver 100 and a gamma voltage generator 80.

The main system 10 supplies pixel data (RGB), a control signal (CONT), a driving voltage (VDD), a backlight driving voltage (BLV) and the like to the receiver 20. The main system 10 digitalizes and compresses the pixel data (RGB) and the control signal (CONT), etc., and lowers a voltage by a differential signal and supplies it to the receiver 20. The differential signal includes a first signal and a second signal which has an inversed phase to the first signal. The differential signal may use a low voltage differential signaling (LVDS).

The receiver 20 receives the pixel data (RGB), the control signal (CONT), etc., and then supplies them to the controller 60. The receiver 20 supplies the driving voltage (VDD) and the backlight driving voltage (BLV) which are supplied from the main system 10 to the driving power supply 30 and the backlight power supply 40, respectively.

When the driving voltage (VDD) is supplied from outside to the driving power supply 30, the driving power supply 30 supplies the driving voltage (VDD) to the controller 60 including a digital circuit, the data driver 90 and the gate driver 100. The driving power supply 30 generates a gate-on voltage (VON) and a gate-off voltage (VOFF) as the driving voltage (VDD) and supplies the gate-on voltage (VON) and the gate-off voltage (VOFF) to the gate driver 100. The driving power supply 30 outputs an overall output voltage including the gate-on voltage (VON), the gate-off voltage (VOFF), a common voltage (VCOM) and an analog driving voltage (AVDD) into a ground voltage level when a supply of the driving voltage (VDD) is cut off from outside. The ground voltage level may be 0V.

The backlight driving voltage (BLV) is supplied to the backlight power supply 40 through the receiver 20. The backlight power supply 40 supplies a backlight on voltage and a backlight off voltage to a backlight unit (not shown). The backlight unit may include a light emitting diode (LED).

The backlight power supply 40 generates a SET signal when the backlight on/off voltage is supplied. For example, the SET signal includes a high/low level. The SET signal becomes a high level when the backlight on voltage is output, and becomes a low level when the backlight off voltage is output.

The power-off sensor 50 is connected to the power supply 40, the receiver 20, and the controller 60. The power-off sensor 50 distorts a clock signal (CLK) which is inputted from the receiver 20 through the SET signal of the backlight driving voltage (BLV). The power-off sensor 50 will be more specifically described later.

The controller 60 restores the received pixel data (RGB) and the control signal (CONT) which are converted into differential signals by the receiver 20 so as to compare the pair of signals and detect an error thereof. For example, the controller 60 restores and outputs the pixel data (RGB) and the control signal (CONT) by using a voltage difference between the differential signals which are converted into low voltage differential signals. The controller 60 generates and outputs a data control signal (DCS) to control the data driver 90, and a gate control signal (GCS) to control the gate driver 100 by using the restored control signal (CONT). The data control signal (DCS) which is generated from the controller 60 includes a source start pulse (SSP), a source shift clock (SSC), etc., and the gate control signal (GCS) includes a gate start pulse (GSP), a gate shift clock (GSC), etc. The controller 60 re-arrays the pixel data (RGB) supplied from the receiver 20 in accordance with a driving order of the data driver 90 and supplies them to the data driver 90.

The controller 60 receives the clock signal (CLK) which is distorted by the power-off sensor 50 during the outside power-off and determines a signal error. When the controller 60 senses the signal error, the controller 60 operates in a built-in self test pattern (BIST) mode. The BIST mode is an operating mode in which predetermined after-image removing gray-scale signals (WS and BS) are output to the data driver 90 together with the pixel data (RGB). Accordingly, when the controller 60 operates in the BIST mode, the data driver 90 can apply a gray-scale display voltage of the same gray-scale to a liquid crystal cell according to a minimum applying voltage. A detailed description thereof will be described later together with the power-off sensor 50.

The liquid crystal panel 70 includes an upper substrate on which a color filter and a common electrode are formed, a lower substrate on which a TFT is formed, a liquid crystal layer which is interposed between the upper substrate and the lower substrate. The lower substrate includes a liquid crystal capacitor (Clc), and the TFT which is connected to a plurality of gate lines (GL1, . . . , GLn) and a plurality of data lines (DL1, . . . , DLm) and applies the gray-scale display voltage to the liquid crystal capacitor (Clc) in response to the gage on voltage (VON). The TFT includes a gate which is connected to the gate line (GL1), a source which is connected to the data line (DL1) and a drain which is connected to a pixel electrode of the liquid crystal capacitor (Clc).

The gamma voltage generator 80 divides the analog driving voltage (AVDD) supplied from the driving power supply 30 and generates a gamma voltage (VGMA), and then supplies the gamma voltage (VGMA) to the data driver 90.

The data driver 90 generates the gray-scale display voltage corresponding to the pixel data (RGB) and the after-image removing gray-scale signals (WS and BS) using the gamma voltage, and applies the gray-scale display voltage to the TFT which is driven by the gate-on voltage (VON), thereby displaying the gray-scale display voltage in a unit of the gate line (GL1, . . . , GLn). To this end, the data driver 90 receives the data control signal (DCS) and the data signal (RGB) from the controller 60 and also receives the gamma voltage (VGMA) from the gamma voltage generator 80.

The data driver 90 is prepared with a data driving integrated circuit (IC) and adhered to the liquid crystal display panel 70 in a tape carrier package (TCP) type. Alternatively, the data driver 90 may be directly installed on a non-display area of the liquid crystal panel 70 in a chip on glass (COG) type.

The gate driver 100 sequentially applies the gate-on voltage (VON) to the plurality of gate lines (GL1, . . . , GLn) and applies the gate-off voltage (VOFF) to a gate line to which the gate-on voltage (VON) is not applied. That is, the gate driver 100 turns on the plurality of the TFTs which are respectively connected to the sequentially selected gate lines (GL1, . . . , GLn) at the same time. To this end, the gate driver 100 receives the control signal (GCS) from the controller 60, and receives the gate-on voltage (VON) and the gate-off voltage (VOFF) from the driving power supply 30.

The gate driver 100 may be prepared with the gate driving IC and adhered to the liquid crystal panel 70. Alternatively, the gate driver 100 may be integrated on the non-display area of the liquid crystal panel as an amorphous silicon gate (ASG) when the TFT is formed.

The driving time point of an after-image removing gray-scale signal in the liquid crystal display according to the exemplary embodiment of the present invention will be described with reference to FIG. 2.

Figure 2:
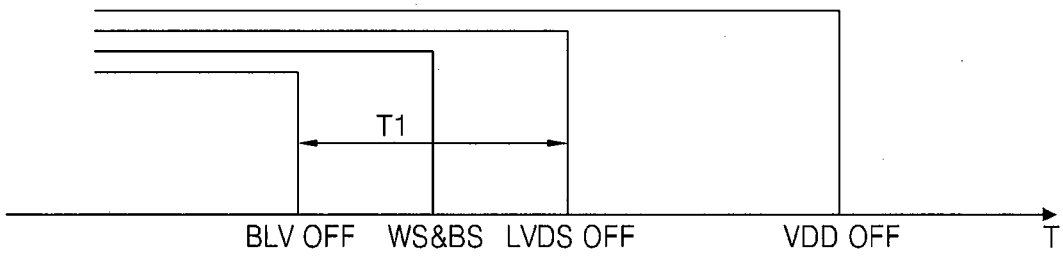
FIG. 2 is a block diagram illustrating a signal order during a power-off operation in the liquid crystal display according to the exemplary embodiment of the present invention.

FIG. 2 is a drawing illustrating a signal order during a power-off in the liquid crystal display according to the exemplary embodiment of the present invention.

As shown in FIG. 2, the backlight driving voltage (BLV) is powered off the moment when the outside power is cut off. Then, the differential signals (LVDS) including the pixel data (RGB) and the control signal (CONT) are powered off. Thereafter, the driving voltage (VDD) which is supplied through the driving power supply 30 is powered off.

The after-image removing gray-scale signals (WS and BS) are applied to the data driver 90 during a delay time (T1) between an off time point of the backlight driving voltage and an off time point of the differential signal in order to get rid of the after-image displayed in the liquid crystal panel. Then, the data driver 90 applies the gray-scale voltage corresponding to the after-image removing gray-scale signals (WS and BS) to the liquid crystal panel and displays a white or a black color on the liquid crystal panel.

The power-off sensor 50 and the controller 60 for generating the after-image removing gray-scale signals will be described in detail by referring to FIG. 3 and FIG. 4.

Figure 3:
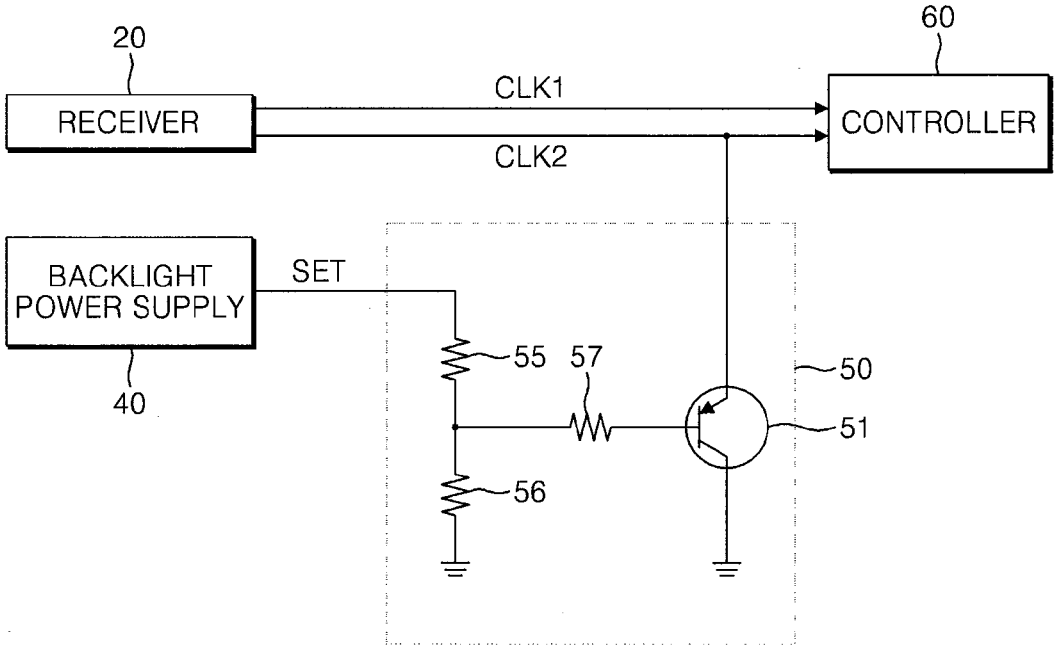
FIG. 3 is a diagram illustrating a power-off sensor shown in FIG. 1.

FIG. 3 is a block diagram illustrating the power-off sensor 50 in FIG. 1.

Referring to FIG. 3, the power-off sensor 50 includes first to third resistors 55, 56 and 57 and a transistor 51.

The first to third resistors 55, 56 and 57 are connected in series and in parallel between the backlight power supply 40 and the transistor 51.

The transistor 51 is connected between the receiver 20 and the controller 60 and switches the clock (CLK) supplied to the controller 60 from the receiver 20 to ground. The transistor 51 may employ a P-type bipolar transistor. Alternatively, the transistor 51 may be a metal oxide silicon (MOS) transistor performing the same function as the P-type bipolar transistor.

The SET signal indicated by the backlight on/off voltage is applied from the power supply 40 to the base of the transistor 51 through the first to third resistors 55, 56 and 57. The SET signal includes a high level and a low level. The SET signal becomes high when the backlight-on voltage is output, and becomes low when the backlight-off voltage is output. Then, a second signal (CLK2) among the clock signals (CLK1 and CLK2) applied to the controller 60 from the receiver 20 is applied to an emitter of the transistor 51. Further, a collector of the transistor 51 is connected to a ground (GND).

When the backlight unit is powered on and the high SET signal is applied, the transistor 51 is turned off because a voltage between the base and the emitter is lower than a threshold voltage of the transistor 51. On the other hand, when the backlight unit is powered off and the low SET signal is applied, the transistor 51 is turned on because the voltage between the base and the emitter is higher than the threshold voltage of the transistor 51. Accordingly, the transistor 51 is turned on when the backlight unit is powered off, thereby grounding the second signal (CLK2) applied to the controller 60 from the receiver 20.

The transistor 51 according to the exemplary embodiment of the present invention is not limited to the grounding of the second signal (CLK2), but may ground the first signal (CLK1).

Figure 4:
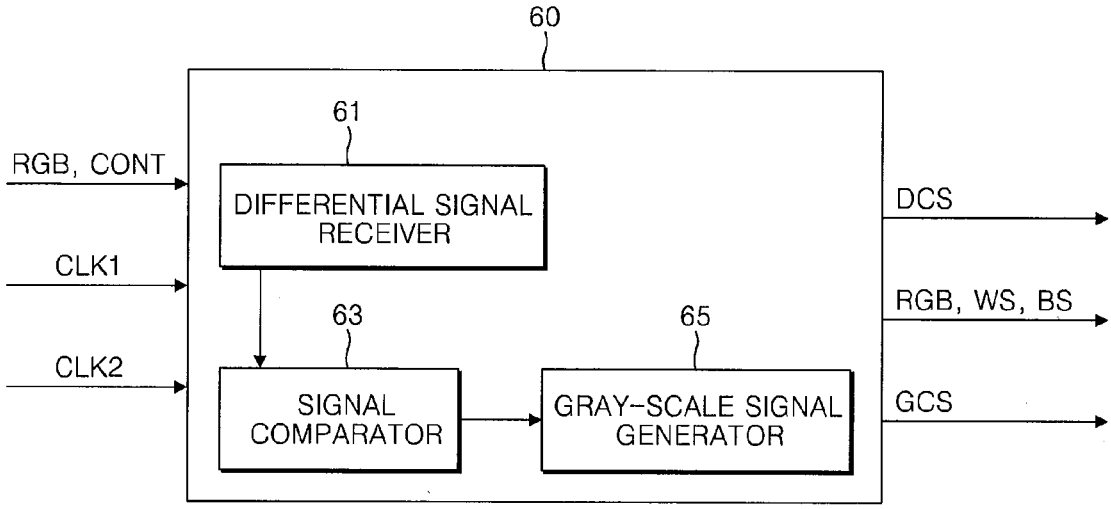
FIG. 4 is a block diagram illustrating a controller in FIG. 1.

FIG. 4 is a block diagram illustrating the controller in FIG. 1.

Referring to FIG. 4, the controller 60 includes a differential signal receiver 61, a signal comparator 63 and a gray-scale signal generator 65.

The differential signal receiver 61 receives the pixel data (RGB), the control signal (CONT), the first signal (CLK1), and the second signal (CLK2). As shown in FIG. 3, the second signal CLK2 can be grounded by the power-off sensor 50. The differential signal receiver 61 applies the first and the second signals (CLK1 and CLK2) to the signal comparator 63.

The signal comparator 63 compares the phase difference of the first and the second signals (CLK1 and CLK2) and determines a signal error. The signal comparator 63 can detect a power-off state of the backlight unit by sensing the second signal (CLK2) when it is distorted (grounded) by the power-off sensor 50. The signal comparator 63 informs the gray-scale signal generator 65 of the signal error.

The gray-scale signal generator 65 generates an after-image removing gray-scale signal according to the signal error information. More specifically, the gray-scale signal generator 65 applies the after-image removing gray-scale signals (WS and BS) to the data driver 90 in response to the signal error information. To this end, when the backlight unit is powered off, the gray-scale signal generator 65 is converted into the BIST mode from a normal mode and outputs a predetermined white or black after-image removing gray-scale signal (WS or BS). For example, the gray-scale signal generator 65 may include an EEPROM and stores the gray-scale signal for removing the after-image. The gray-scale signal generator 65 stores the gray-scale signal so as to apply the gray-scale display voltage of the same gray-scale by the minimum applying voltage to the liquid crystal cell.

The gray-scale signal generator 65 may store a gray-scale signal for displaying a white or a black according to a liquid crystal mode. Accordingly, the gray-scale signal generator 65 applies the white after-image removing gray-scale signal (WS) to the data driver 90 when the liquid crystal mode is in a normally white mode (NW). When the liquid crystal mode is in a normally black mode (NB), the gray-scale signal generator 65 applies the black after-image removing gray-scale signal (BS) to the data driver 90.

The controller 60 applies the after-image removing gray-scale signals (WS and BS) to the data driver 90, thereby displaying a white or a black image on the liquid crystal panel. Accordingly, the controller 60 can remove the after-image due to a discharge error of the liquid crystal panel when the backlight unit is powered off and the driving voltage is off.

The liquid crystal display according to the exemplary embodiment of the present invention is not only applied to the case that the liquid crystal display is driven to remove the after-image only the time of the power-off of the controller 60, but also to the case that the liquid crystal display is driven to get rid of the after-image in the BITS mode when the backlight unit is temporarily powered off, for example, in the case of a channel conversion.

The driving method of the liquid crystal display according to an exemplary embodiment of the present invention will be described referring to FIG. 5.

Figure 5:
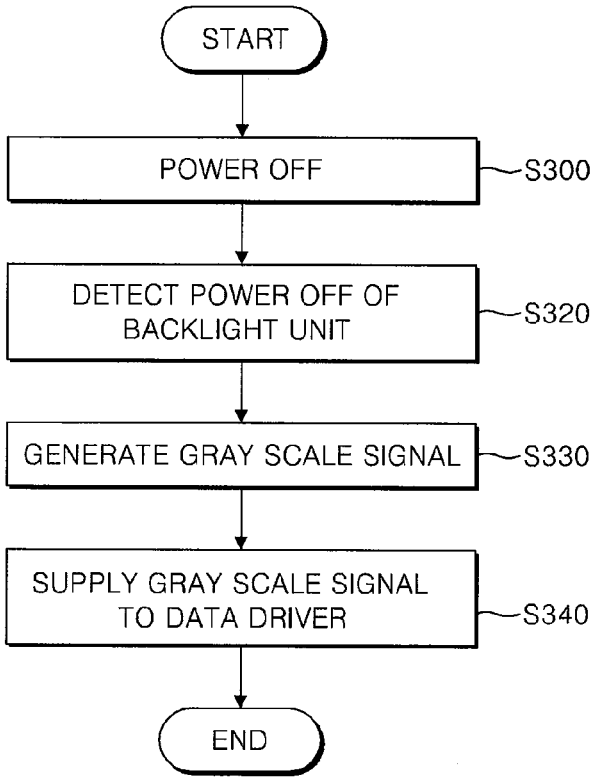
FIG. 5 is a flowchart illustrating a driving method of the liquid crystal display according to the exemplary embodiment of the present invention.

FIG. 5 is a flowchart illustrating the driving method of the liquid crystal display according to the exemplary embodiment of the present invention.

As shown in FIG. 5, the driving method of the liquid crystal display according to the exemplary embodiment of the present invention includes the operations of power-off (step S300), detecting power-off of the backlight unit (step S320), generating an after-image removing gray-scale signal (step S330), and applying the after-image removing signal (step S340).

At first, in the power-off operation (step S300), a user cuts off power supply of the main system 10 in the liquid crystal display. For example, the user may cut off power through a power switch of a mobile phone or a lap top computer.

Next, in the operation of detecting the power-off of the backlight unit (step S320), the power on/off state of the backlight unit is detected by the power-off sensor 50 from the backlight power supply 40 and the differential signal applied to the controller 60 from the receiver 20 is distorted.

The power-off sensor 50 is connected to the backlight power supply 40 and applies a high/low SET signal to a P-type transistor during power on/off of the backlight unit. When the backlight unit is powered off, the P-type transistor is turned on by the low SET signal and grounds the differential signal applied to the controller 60 from the receiver 20. When the differential signal is applied from the receiver 20, the controller 60 compares a phase difference between a signal grounded by the power-off sensor 50 and a normal signal to detect a signal error.

Then, in the operation of generating the after-image removing gray-scale signal (step S330), the controller 60 which has detected the signal error is converted into the BIST mode from a normal mode and generates the after-image removing gray-scale signal through the gray-scale signal generator 65. The BIST mode displays a predetermined image so as to control an image display operation of the liquid crystal panel when it is determined that the pixel data (RGB) is abnormal by a noise or a short-circuit of the signal line, etc.

Finally, in the operation of supplying the after-image removing gray-scale signal (step S340), the controller 60 in the BIST mode applies the after-image removing gray-scale signal to the data driver 90 so as to control the image display operation of the liquid crystal panel. The gray-scale signal generator 65 applies a white gray-scale signal when the liquid crystal panel is in the normally white mode, and applies a black gray-scale signal when the liquid crystal panel is in the normally black mode. Accordingly, the liquid crystal panel displays an image corresponding to the after-image removing gray-scale signal between the backlight power-off time point and the differential signal off time point, and thus is driven while being advantageous for discharge.

Hereinafter, a power-off operation according to the liquid crystal modes will be described with reference to FIG. 6 and FIG. 7.

Figure 6:
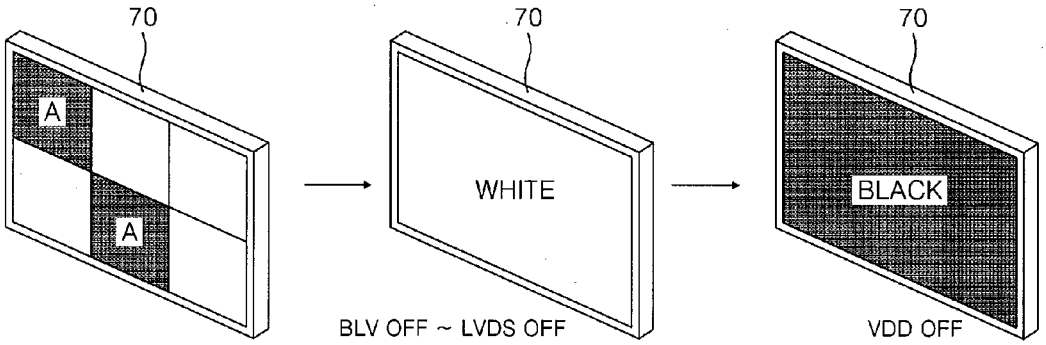
FIG. 6 and FIG. 7 are views for illustrating a power-off operating order in the driving method of the liquid crystal display according to the exemplary embodiment of the present invention.
Figure 7:
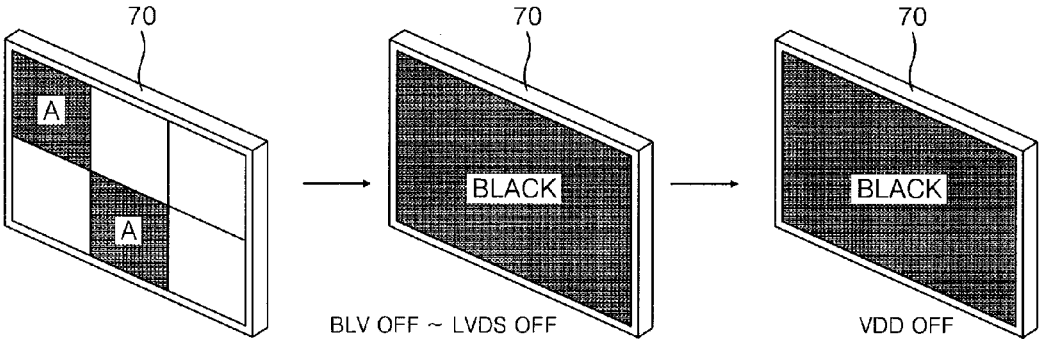

FIG. 6 and FIG. 7 are views for illustrating the power-off operating order in the driving method of the liquid crystal display according to the exemplary embodiment of the present invention.

FIG. 6 illustrates images of the liquid crystal panel according to the power-off operation when the liquid crystal mode is in the normally white mode. When an image of an area A displayed in a power on state is off, the liquid crystal panel applies the white gray-scale signal to the data driver 90 between the power-off time point of the backlight voltage (BLV) and the power-off time point of the differential signal to display the white gray-scale. Then, the liquid crystal panel displays a black gray-scale by the power-off of the driving voltage after displaying the white gray-scale.

FIG. 7 illustrates images of the liquid crystal panel according to the power-off operation when the liquid crystal mode is in the normally black mode. When the image of the area A displayed in the power on state is off, the liquid crystal panel applies the black gray-scale signal to the data driver 90 between the power-off time point of the backlight voltage (BLV) and the power-off time point of the differential signal to display the black gray-scale. Then, the liquid crystal panel displays the black gray-scale by the power-off of the driving voltage after displaying the black gray-scale.

As described above, the liquid crystal display according to the present invention includes the power-off sensor to distort the differential signal during the power-off of the backlight unit. Accordingly, the liquid crystal display generates a certain gray-scale signal and displays the certain gray-scale on the liquid crystal after power-off of the backlight unit during power-off of the liquid crystal display, thereby removing the after-image of the liquid crystal panel and preventing discharge error.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A liquid crystal display comprising:

a liquid crystal panel displaying image corresponding to a gray-scale voltage;

a receiver for receiving power and differential signals;

a backlight power supply which supplies the power to a backlight unit;

a power-off sensor which senses power-off of the backlight power supply and which distorts one of the differential signals;

a controller which detects distortion of a differential signal and generates an after-image removing gray-scale signal; and a data driver applying the gray-scale voltage corresponding to the after-image removing gray-scale signals to the liquid crystal panel, wherein the after-image removing gray-scale signal is applied to the data driver during a delay time between an off time point of the power and an off time point of the differential signals.

2. The liquid crystal display according to claim 1, wherein the controller comprises a gray-scale signal generator which generates the after-image removing gray-scale signal.

3. The liquid crystal display according to claim 2, wherein the controller comprises a differential signal receiver, and a signal comparator which compares the differential signals.

4. The liquid crystal display according to claim 3, wherein the gray-scale signal generator comprises a memory and outputs the after-image image removing gray-scale signal which is previously stored therein when the power-off of the backlight unit is sensed.

5. The liquid crystal display device according to claim 4, wherein the gray-scale signal generator outputs a white gray-scale signal when a liquid crystal mode is a normally white mode, and outputs a black gray-scale signal when the liquid crystal mode is a normally black mode.

6. The liquid crystal display according to claim 1, wherein the power-off sensor comprises a transistor which functions as a switch and at least one resistor.

7. The liquid crystal display according to claim 6, wherein the power-off sensor grounds one of the differential signals.

8. The liquid crystal display according to claim 7, wherein the power-off sensor comprises a bipolar transistor or a metal oxide silicon (MOS) transistor.

9. The liquid crystal display according to claim 6, wherein the transistor comprises: a first terminal connected to a differential signal line which connects the receiver and the controller; a second terminal connected to the resistor which is connected to the backlight power supply; and a third terminal connected to a ground terminal.

10. The liquid crystal display according to claim 1, the differential signals comprise a first signal and a second signal which has an inversed phase to the first signal.

11. A method of driving a liquid crystal display, comprising:

detecting power-off of a backlight unit by using backlight power and differential signals;

generating an after-image removing gray-scale signal when the power-off of the backlight unit is detected; and applying the after-image removing gray-scale signal to a data driver, wherein the after-image removing gray-scale signal is applied to the data driver during a delay time between an off time point of the backlight power and an off time point of the differential signals.

12. The method of driving the liquid crystal display according to claim 11, wherein one of the differential signals is grounded by using a transistor which functions as a switch, in the detecting the power-off of the backlight unit.

13. The method of driving the liquid crystal display according to claim 11, wherein a white or a black gray-scale signal is generated according to a liquid crystal mode.

14. The method of driving the liquid crystal display according to claim 13, wherein the white gray-scale signal is generated when the liquid crystal mode is a normally white mode, and the black gray-scale signal is generated when the liquid crystal mode is a normally black mode.

* * * * *